United States Patent [19]

Michel et al.

[11] 4,056,098

[45] Nov. 1, 1977

[54] RESPIRATORY APPARATUS FOR FREE UNDERWATER DIVER

[75] Inventors: Alain Marie Michel, Toulon; Jean Edmond Parc, Toulon Naval, both of France

[73] Assignee: Etat Francais, Paris, France

[21] Appl. No.: 647,168

[22] Filed: Jan. 7, 1976

[30] Foreign Application Priority Data

Jan. 17, 1975 France ..... 75.01381

[51] Int. Cl.[2] ..... A62B 7/00

[52] U.S. Cl. ..... 128/142 R; 128/142 G

[58] Field of Search ..... 128/142 R, 142 G, 142.2, 128/142.3, 142.4, 145 R, 145.8, 203, 204, 191 R, DIG. 29, DIG. 17, 2.06 F, 2.05 T, 140 R, 146.5, 202; 240/6.43; 251/140

[56] References Cited

U.S. PATENT DOCUMENTS

| | | | |
|---|---|---|---|
| 2,329,156 | 9/1943 | Coffey | 251/140 |
| 2,871,854 | 2/1959 | Lambertsen | 128/142.2 |
| 3,191,596 | 6/1965 | Bird et al. | 128/145.5 |
| 3,433,222 | 3/1969 | Pinto | 128/142.2 |
| 3,556,098 | 1/1971 | Kanwisher et al. | 128/142 R |
| 3,593,735 | 7/1971 | Reiher | 128/142 R |
| 3,722,510 | 3/1973 | Parker | 128/142 R |
| 3,805,590 | 4/1974 | Ringwall et al. | 128/142 R |
| 3,820,537 | 6/1974 | Almqvist et al. | 128/142.2 |
| 3,859,994 | 1/1975 | Almqvist et al. | 128/142.3 |
| 3,871,170 | 3/1975 | Bergey | 240/6.43 |
| 3,893,459 | 7/1975 | Mausteller et al. | 128/202 |
| 3,957,043 | 5/1976 | Shelby | 128/142 G |

*Primary Examiner*—Dalton L. Truluck
*Assistant Examiner*—Henry J. Recla
*Attorney, Agent, or Firm*—Haseltine, Lake & Waters

[57] ABSTRACT

Respiratory apparatus for a free underwater diver comprising a sealed and deformable respiratory bag in pressure equilibrium with the exterior and into which the diver inspires and expirates. The bag communicates on the one hand with an absorbant means for $CO_2$ and on the other hand, with bottles of oxygen and a compressed neutral gas, the communication with the bottle of neutral gas being effected through a valve secured to a plate on which the wall of the bag acts when the volume thereof is reduced. At least one sensor of the partial pressure of oxygen is disposed in the bag and delivers a voltage signal proportional to the pressure, and an electrovalve is placed in a circuit connecting the oxygen bottle to the bag. An electronic regulation circuit is connected to the sensor and to the electrovalve for automatically controlling the electrovalve to maintain the partial pressure of oxygen in the respiratory bag substantially equal to an adjustable assigned value, the electrovalve and the electronic circuit being placed in a sealed casing which communicates with the interior of the respiratory bag.

8 Claims, 7 Drawing Figures

RESPIRATORY APPARATUS FOR FREE UNDERWATER DIVER

FIELD OF THE INVENTION

The present invention relates to a respiratory apparatus for underwater divers having self-contained air supplies such as skin divers and scuba divers and particularly to respiratory apparatus comprising a closed circuit for normal operation and a semi-closed circuit for safety or emergency operation.

The invention is particularly concerned with the construction of self-contained respiratory apparatus.

BACKGROUND

There is known at present a respiratory apparatus with a semi-closed circuit in which the diver is connected to a small deformable bag or container at the same pressure as the exterior and the diver breathes a respiratory mixture composed of oxygen and a neutral gas, generally nitrogen or helium. This small bag communicates, through a set of valves, with a large deformable bag or container when the diver breathes in and with the exterior when he breaths out. The large container communicates with bottles of pure oxygen and neutral gas, and the percentage, by volume, of oxygen in the large container is automatically regulated by mechanical means.

Such apparatus is not suitable for diving to great depths beyond 200 meters, as the percentage, by volume of the oxygen necessary at these depths is less than 3% and the preparation of the respiratory mixture becomes very delicate.

Another disadvantage of such apparatus arises from the fact that the proportion of neutral gas in the mixture becomes increasingly greater with the depth. Since some neutral gas is discharged to the exterior at the time of each expiration by the diver, the consumption of neutral gas is substantial, which limits the range of the apparatus. For military applications, notably for combat divers, the apparatus with semi-closed circuit also presents the disadvantage of constantly emitting bubbles which permit locating the divers.

There is also known respiratory apparatus for divers having a closed circuit comprising a deformable respiratory bag or container in pressure equilibrium with the exterior which communicates with a cartridge containing an absorbant or $CO_2$. The diver aspirates or expirates into the bag such that the neutral gas is constantly recirculated. The apparatus comprises a bottle of pure oxygen and regulation means for maintaining a determined proportion of oxygen in the respiratory bag.

The apparatus of this type does not consume neutral gas and the diver is not locatable from the surface. Such apparatus permits diving to depths of about 30 meters.

SUMMARY OF THE INVENTION

An object of the present invention is to provide a respiratory apparatus for divers having self-contained respiratory apparatus which permits operating in closed circuit at all depths between 0 and 300 meters by automatic regulation of the partial pressure of oxygen in the respiratory bag to a consigned value which is adjustable by the diver according to the depth at which he operates.

The margin of regulation of the physiologically permissable partial pressure of oxygen is relatively narrow and imposes an automatic regulation of the electronic type. In case of improper functioning of this regulation, the respiratory mixture can have the risk of becoming toxic.

A second object of the invention is to provide a respiratory apparatus which comprises means for displaying the value of the partial pressure of oxygen to the diver, alarm means, a safety or emergency circuit, and manually controlled switch means for permitting the diver to immediately change to the safety circuit in case of irregularity.

The respiratory apparatus according to the invention is composed, in known manner, of a respiratory bag or container which is sealed and deformable, and is in pressure equilibrium with the exterior, the diver aspirating and expirating into the bag, said bag comprising a release valve and communicating on the one hand with absorbant means for $CO_2$, for example, with a cartridge of soda lime, and on the other hand with bottles provided with release valves of oxygen and a compressed neutral gas. The communication between the respiratory container and the bottle of neutral gas, which is, for example, helium, is made through a valve fixed to a plate on which the wall of the bag acts when the volume of the bag is reduced under the effect of the pressure, such that when the depth of immersion increases and the volume of the bag is reduced, neutral gas is automatically admitted into the bag to maintain the volume thereof constantly greater than a determined limit which has for its effect reducing the proportion of oxygen in the respiratory mixture contained in the bag.

The objects of the invention are attained by means of a respiratory apparatus comprising, additionally, at the interior of the respiratory bag, at least one sensor of the partial pressure of oxygen which delivers a voltage proportional to said partial pressure, an electrovalve placed in a circuit connecting the bottle of oxygen to the respiratory bag, and electronic regulation circuits connected to said sensor and to said electrovalve for automatically controlling said electrovalve to maintain the partial pressure of oxygen in the respiratory bag substantially equal to an adjustable consigned value.

According to a characteristic feature of the invention, the electronic circuits are placed in a sealed casing which communicates with the interior of the respiratory bag such that the interior of said casing is in pressure equilibrium with the exterior which avoids the need for the casing to resist the hydrostatic pressure.

The apparatus according to the invention therefore normally functions in closed circuit with an automatic regulation of the partial pressure oxygen obtained by means of a single automatic valve acting solely on the amount of oxygen in the respiratory bag.

The consumption of neutral gas is greatly reduced, since the neutral gas is recirculated. The bottle of neutral gas serves to automatically compensate diminution of volume of the respiratory bag during descent of the diver by the action of the automatic plate.

The second object of the invention is attained by additionally providing the apparatus with a safety arrangement, operating in semi-closed circuit, which is composed of a bottle provided with a release valve containing a respiratory mixture of oxygen and a compressed neutral gas, which bottle is connected, as are the oxygen and the neutral gas bottles, to a distributor having two positions provided with a manipulating lever which distributor permits the diver to interrupt the feed of the respiratory bag from the bottles of oxygen and of neutral gas and to replace it by a safety or emergency feed from the bottle containing the respiratory gas mixture.

The apparatus according to the invention further comprises a bracelet fixed to the wrist of the diver on which is displayed the numerical value of the partial pressure of oxygen by means of two numerals produced by electroluminescent diodes. This bracelet is connected to the respiratory bag by a flexible tube such that it is in pressure equilibrium with the exterior, and electrical conductors connecting the electronic circuits and the numerical display indicator are disposed in the interior of said tube.

The bracelet carries a switch permitting the diver to control intermittently the display of the partial pressure of oxygen. It also comprises a commutator permitting the diver to vary the consigned value of regulation of the partial pressure of oxygen according to the depth at which he finds himself.

The result of the invention is a novel respiratory apparatus for divers with self-contained breathing apparatus constructed in the form of a compact assembly fixed on a base provided with straps permitting attachment of the apparatus on the back or the chest of the diver, this assembly being placed in the interior of a non-sealed stream-lined body formed of two shells of laminated resin, one of which shells is fixed to the base.

This apparatus equipped with bottles of oxygen and helium, has the advantage of permitting immersion to all depths between 0 and 300 meters while normally utilizing a closed circuit during the phases of descent and operation at a given level. This advantage is particularly important for apparatus adapted for combat swimmers who can thus dive to relatively substantial depths without being detectable due to bubbles arriving at the surface.

Another advantage of the apparatus according to the invention resides in the fact that it comprises a safety or emergency circuit permitting the diver, in case of any damage whatsoever of the normal circuit, notably in case of malfunction of the regulation, to return to his base of operation.

The consumption of neutral gas, notably helium, is reduced due to the fact that the apparatus normally functions in closed circuit with recycling of the neutral gas which permits obtaining individual compact apparatus having a great independence of operation, even at great depths, the consumption of neutral gas being independent of the depth.

Another advantage, considering that helium is a relatively expensive gas, is the reduction of the cost thereof for a given time of immersion.

The apparatus according to the invention avoids the necessity of manufacturing special respiratory mixtures.

The following description refers to the annexed drawings which illustrate one embodiment of an apparatus according to the invention without any limiting character.

DETAILED DESCRIPTION

Figure 1:
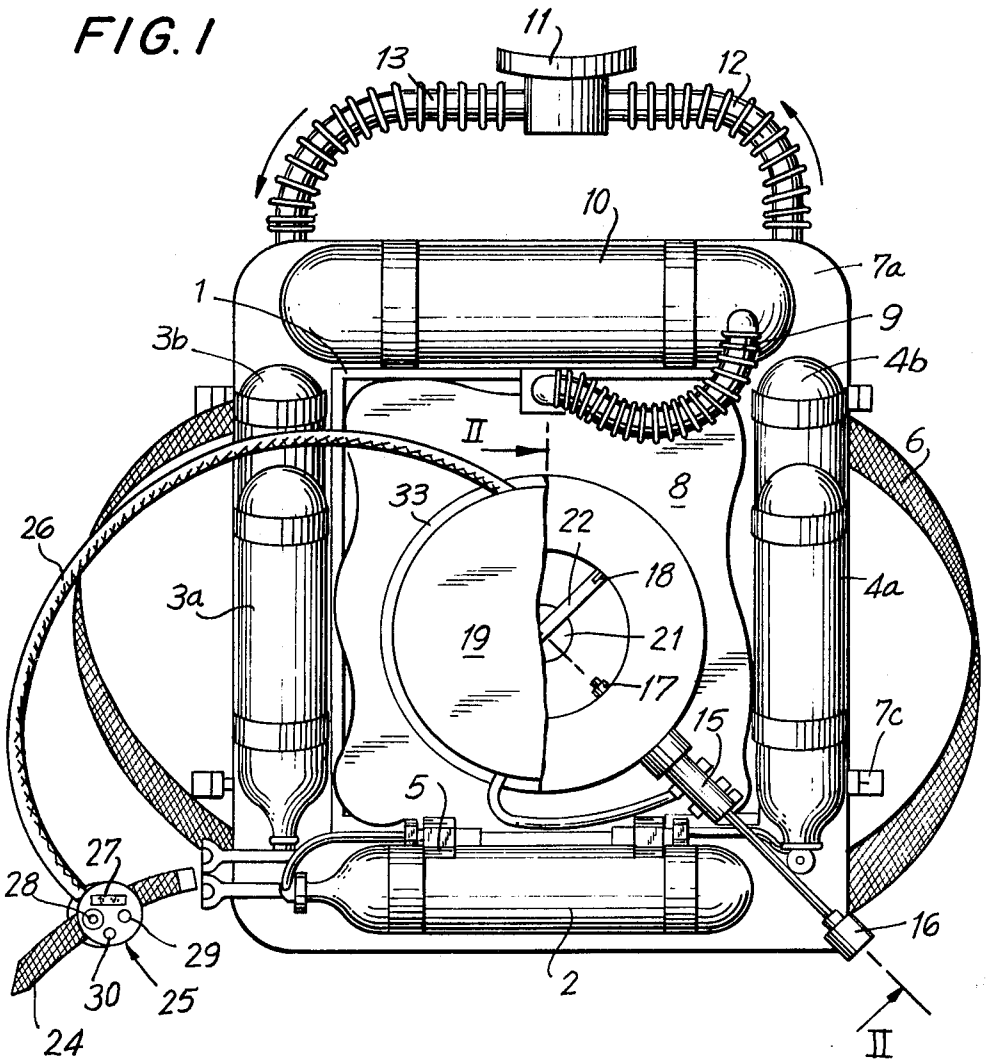
FIG. 1 is an elevational view of the assembly of the apparatus according to the invention partly broken away.

FIG. 1 shows a self-contained respiratory apparatus for underwater divers of compact form which is composed essentially of a rigid base 1 in the form of a rectangular frame. The base supports two bottles of oxygen 2, two bottles of helium 3*a*, 3*b* and two bottles 4*a*,4*b* containing a respiratory mixture of helium and oxygen in determined proportions. Each group of two bottles is equipped with a release mechanism such as 5. Fixed to the base 1 are straps 6 permitting the diver to carry the apparatus on his back or chest. The apparatus further comprises a streamlined body formed of two shells of laminated resin assembled by suitable fixation means such as 7*c*. One of the shells 7*a* is shown in FIG. 1, shell 7*a* being fixed to the base 1. The shells are not sealed and they have openings of sufficient size to permit flow of water between the interior and the exterior.

Within the confines of the base 1 there is disposed a respiratory bag or container 8 which is sealed and is deformable, and communicates through a flexible cable 9 with a cartridge 10 containing soda lime which absorbs carbon dioxide gas.

The gas contained in the respiratory bag 8 is in pressure equilibrium with the exterior. The diver breathes through a mouth piece 11 which communicates with the respiratory bag through two flexible conduits 12,13 respectively for inspiration and expiration, said conduits being provided with valves as is entirely conventional.

The respiratory bag 8 comprises at the rear an escape valve 14 (FIG. 2) which allows escape of gas when the pressure in the respiratory bag becomes greater than the hydrostatic pressure.

The apparatus further comprises a distributor 15 having a slide secured to an operating lever 16 and displaceable between two positions. Connected to the distributor are inlet and outlet conduits respectively for oxygen, helium and the respiratory emergency mixture contained in bottles 4*a* and 4*b*. A more detailed description of the distributor will be given later with reference to FIG. 5. There is seen in FIG. 1 a nozzle 17 for introduction of the respiratory mixture into the bag and a nozzle 18 for distribution of helium. A nozzle for introduction of oxygen is also provided but is not visible in FIG. 1.

There is shown in partial section in FIG. 1 a casing 19 which is mounted in sealed manner on a rigid support plate 33 fixed to the respiratory bag such that the interior of the casing 19 communicates with the interior of the respiratory bag and is in pressure equilibrium with the exterior.

The casing 19 contains electronic circuits 20 for regulation of a display and for an alarm which will be described in greater detail later in the description.

On the right side of FIG. 1, the casing 19 is removed in order to show a movable plate 21 fixed to a lever 22 which acts on a valve 23 (FIG. 2) placed in the nozzle 18 for supply of helium. Such plate is well known and willl not be described in detail. It is only to be recalled that when the hydrostatic pressure increases during descent of the diver, the bag 8 is compressed and in the course of compressing, it pushes the plate 21 which opens the inlet valve for supplying helium to compensate for the diminution of the volume of the bag. The proportion of neutral gas in the mixture contained in the respiratory bag thus increases. This arrival of supplementary neutral gas is correlated with the consumption of oxygen by the diver and as a result avoids an increase of the partial pressure of oxygen beyond limit values which are physiologically acceptable.

The apparatus according to the invention further comprises a bracelet 24 which can be fixed around the wrist of the diver and which carries a sealed casing 25 connected to the casing 19 by a flexible tube 26 such that the interior of the casing 25 is at the same pressure with the exterior. The casing 25 contains an indicator 27 for display, by electroluminescent diodes, of the value of the partial pressure of oxygen in the container 8.

This display is effected by means of two numerals permitting display to two significant figures of the partial pressure expressed in hundredths of bars which is sufficient for diving at normal depths where the partial pressure of oxygen is situated in the range between 0.30 and 0.80 bars.

For other types of diving, one can utilize partial pressures of oxygen greater than one bar and attaining 1.8 to 2 bars. In this case, one can nevertheless utilize a display by means of two significant figures, while having a precision of one hundredths of a bar as the range of variation of the partial pressure is relatively narrow and less than one bar.

The casing 25 comprises, in addition, a control button 28 solid with an index which has a face with graduations. This control button serves as the actuator of a commutator which permits the diver to regulate, in the course of diving, the value assigned to the partial pressure of oxygen.

The casing 25 also carries a button 29 which controls a switch permitting the diver to activate the luminescent display of the partial pressure of oxygen periodically as desired in order to economize on energy.

Furthermore, while conventional numerical display indicators have three numerals, there is utilized an indicator with only two numerals to economize on energy.

The casing 25 also comprises a visual alarm constituted by an electroluminescent diode 30. This is illuminated when the voltage of batteries supplying the electronic regulation circuits becomes less than a determined threshold value, for example, a threshold of 10.5 volts for a battery of 12 volts. When the alarm is illuminated, the diver is informed that he must return to his base. The threshold of the alarm is selected at a value such that he can return while continuing to utilize the regulation whose operation remains satisfactory up to a battery voltage, for example, of 9.5 volts.

The electrical conductors connecting the bracelet casing 25 to the main casing 19 pass in the interior of the flexible tube 26 which serves as a sheath therefor.

Figure 2:
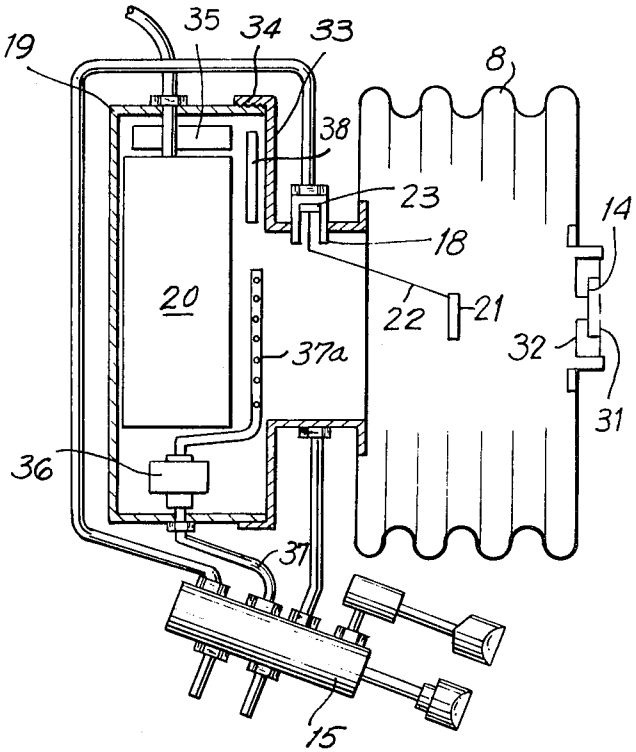
FIG. 2 is a schematic transverse sectional view taken on line II—II in FIG. 1.

FIG. 2 schematically shows only the respiratory bag 8 and the distributor 15.

In this figure is seen the respiratory bag 8 in the form of a bellows provided at the center of its rear wall with the escape valve 14 placed behind a perforated plate 31.

Also seen in this figure is the plate 21 against which rigid plate 32 bears when the bellows 8 is flattened under the effect of the external pressure. Also seen is the valve 23 placed in the nozzle 18 for inlet of helium which valve is opened under the action of lever 22 fixed to the plate 21. The respiratory bag 8 is mounted on a rigid flat plate 33 on which the casing 19 is also mounted. A seal 34 serves to seal the mounting of the casing on the plate. The interior of the casing 19 is in direct communication with the interior of the respiratory bag 8.

At the interior of the casing 19 there is found, in addition the electronic circuits 20 mounted on printed circuit boards, batteries 35 of nickel-cadmium type furnishing a voltage of 12 volts and an electrovalve 36 disposed in the oxygen feed conduit coming from the distributor 15.

The outlet of the electrovalve 36 is connected to a perforated member 37*a* which distributes the oxygen into the respiratory bag.

This perforated member 37*a* assures a good distribution of the oxygen throughout the entire bag.

The casing 19 also contains two sensors 38 for the partial pressure of oxygen. Two sensors are utilized and not only one to compensate for breakdown of either one of the sensors.

These sensors are polarographic probes of the Beckman type which are in the form of a tubular silver anode at the interior of which is disposed its cathode separated from the anode by epoxy resins. These electrodes are immersed in an electrolyte which is a solution of potassium chloride and separated from the exterior of a Teflon membrane permeable to gas.

A stabilized polarization voltage of 0.8 volts is applied to the anode. The oxygen which diffuses through the membrane is reduced upon contact with the cathode and this reduction leads to the passage of a current between the anode and cathode proportional to the partial pressure of oxygen. The signal furnished by the probe is amplified by means of an operational amplifier and a thermistor is incorporated in the feedback loop thereof to compensate for effects of variations of temperature such that there is obtained at the output of the amplifier a voltage varying linearly between 0.07 and 0.7 volts for a partial pressure of oxygen varying between 0.21 bars and 2 bars.

Figure 3:
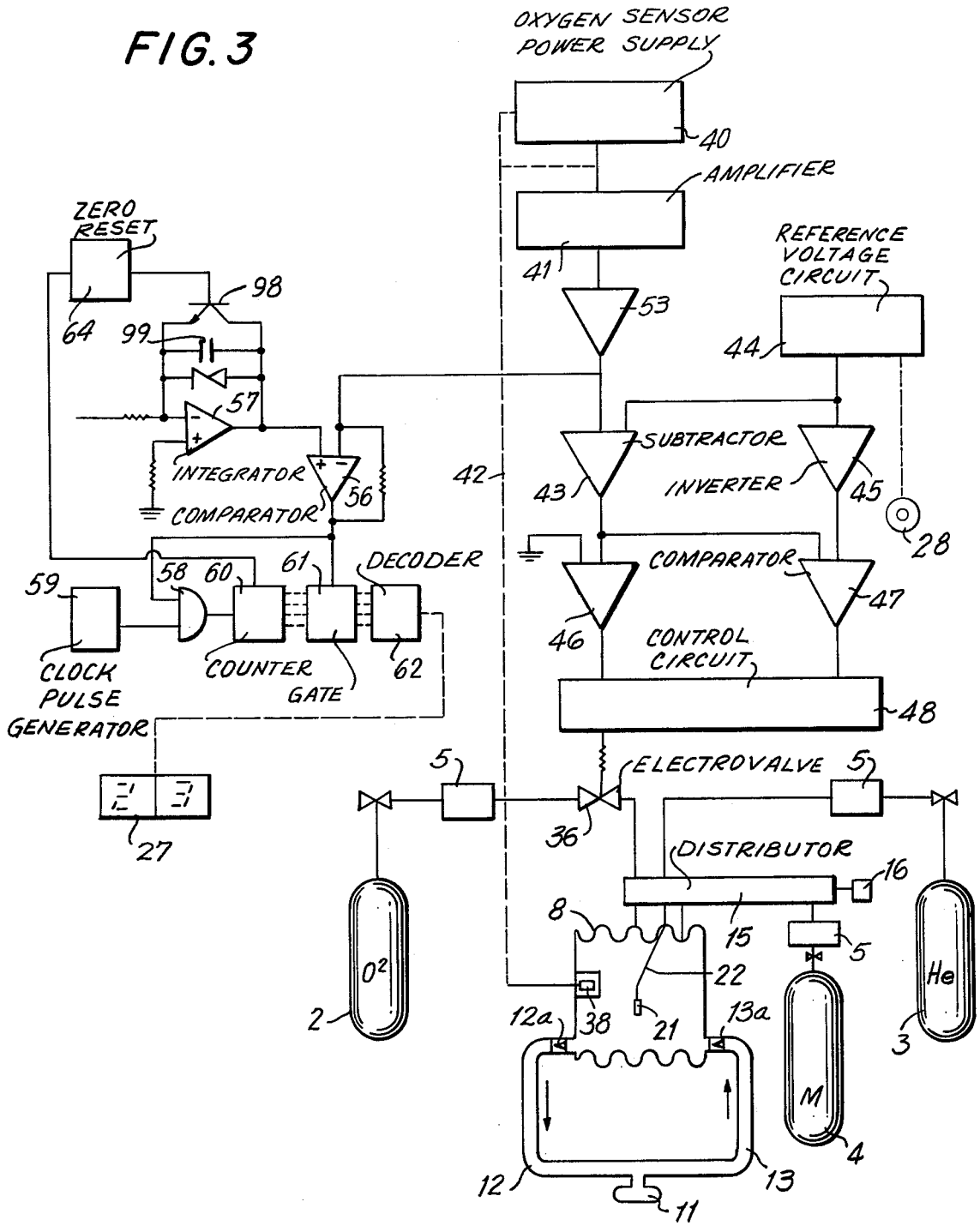
FIG. 3 is a circuit diagram of the apparatus.

FIG. 3 shows a schematic circuit diagram of the main circuits of an apparatus according to the invention.

The parts of the apparatus already described are designated by the same reference characters as in FIGS. 1 and 2. There is thus found in FIG. 3 the respiratory bag 8 provided with the mouthpiece 11 which communicates therewith by means of the inspiration conduit 12 and the expiration conduit 13 provided with valves 12*a* and 13*a.* In the bag 8 is placed the probe 38 for sensing the partial pressure of oxygen.

Also seen in this figure is one of the bottles 2 of oxygen, one of the bottles 3 of helium, and one of the bottles 4 of emergency respiratory mixture, all three bottles being connected to the distributor 15 equipped with the manipulating lever 16. Each bottle is provided with a release mechanism 5.

The inlet of helium into the respiratory bag is controlled by the plate 21 acting on valve 23 through the intermediary of the lever 22. The conduit coming from the bottle of oxygen opens into the electrovalve 36 which is automatically controlled by an electronic regulation circuit. This circuit comprises a circuit 40 which feeds the sensor with regulated DC voltage which serves to polarize the electrodes of the probe.

The electrical signal furnished by the probe, which is a voltage proportional to the partial pressure of oxygen, is amplified by an amplifier 41. There is shown in dotted lines in FIG. 3 the connection 42 between the probe 38 and the power supply circuit 40 and amplifier 41.

The amplified voltage delivered by 41 is supplied to the inlet of a follower amplifier 53 of adjustable gain which permits the standardization of the probe.

A subtractor 43 determines the difference between the voltage delivered from 53 and a reference voltage coming from circuit 44 which permits adjustment of the assigned value of partial pressure. This circuit 44 comprises commutator 28 placed in the casing 25 fixed to the wrist of the diver by the bracelet. An inverter 45 delivers a voltage equal and opposite in value to the reference voltage from the circuit 44.

The subtractor 43 delivers an error voltage proportional to the difference between the reference voltage and the voltage furnished by the amplifier 53. When this error voltage remains less than a first threshold value of zero, comparators 46 and 47 are in a lower logic state and a control circuit 48 effects closure of the electrovalve 36. When the error voltage exceeds the first threshold value but remains below a second positive threshold value, the comparator 46 passes to the upper logic state and the comparator 47 remains at the lower logic state. The circuit 48 then effects opening, successively and discontinuously, of the electrovalve 36. When the error voltage exceeds the second threshold value, the comparators 46 and 47 are in the high logic state, the circuit 48 effects continuous opening of the electrovalve 36 during all the time when the error voltage is greater than the second threshold value.

Figure 4:
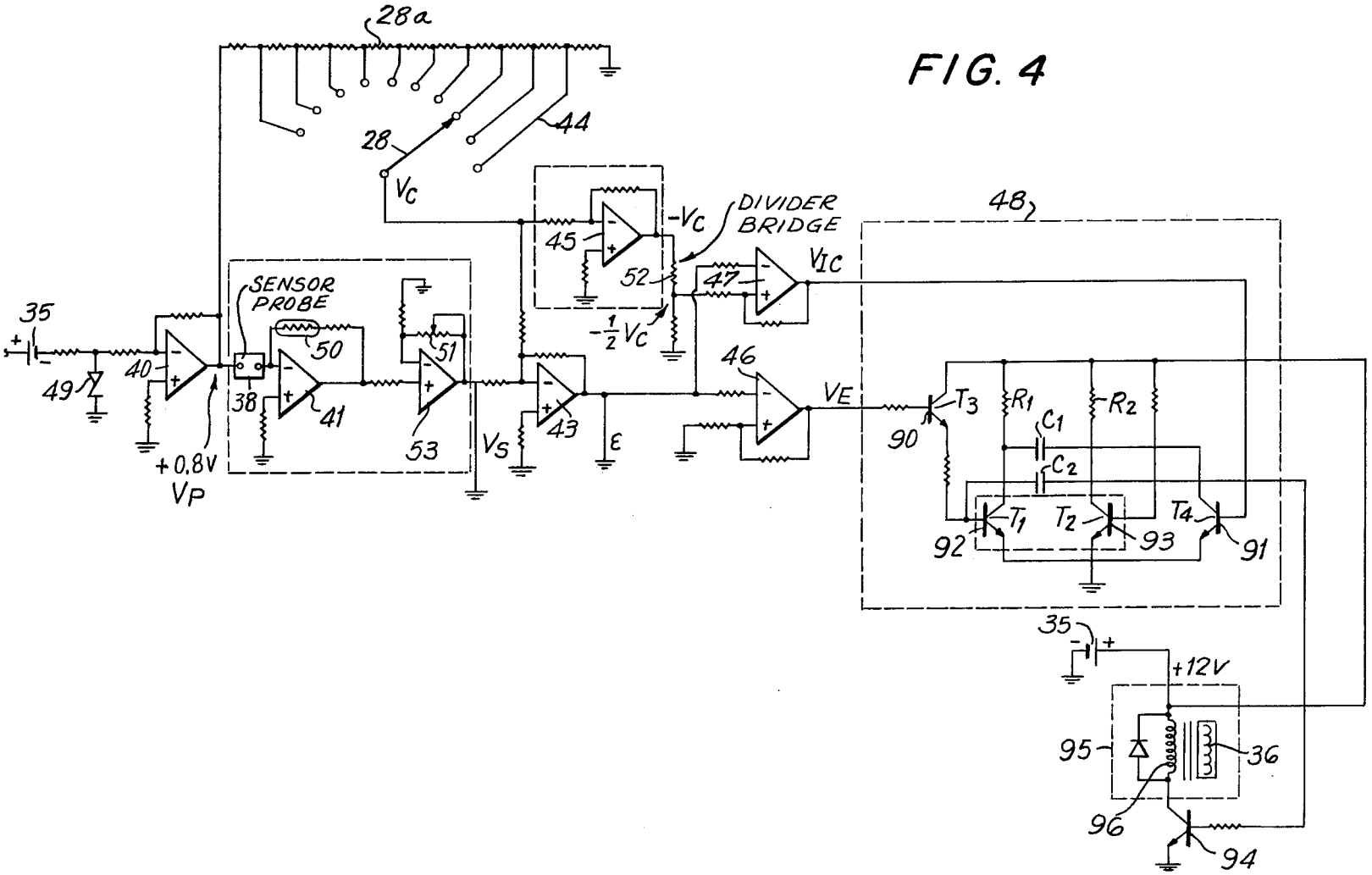
FIG. 4 is a schematic circuit diagram of the electronic regulation circuits.

FIG. 4 shows the electronic regulation circuits for the partial pressure of oxygen. All the operational amplifiers are fed with +12 volts and −12 volts.

There is seen in this figure, the probe 38 of the sensor of partial pressure of oxygen, and the electrovalve 36 which controls the feed of oxygen into the respiratory bag.

The batteries of 35 deliver a voltage of +12 volts and −12 volts. The voltage of −12 volts is conducted by a Zener diode 49 which delivers a stabilized voltage, for example, of −8.5 volts. An amplifier 40 forms a separation stage between the diode 49 and the probe 38. This amplifier has, for example, a gain equal to 0.094 such that the polarization voltage of the probe V = 0.8 volts.

The operation of the probe is not affected by discharge of the batteries as long as the voltage at the output of the batteries remains greater than 10.5 volts. The signal furnished by the probe 38 is amplified by the amplifier 41 which is an operational amplifier with a feedback loop containing a thermistor 50 such that the voltage at the output of the amplifier 41 varies linearly between 0.07 and 0.7 volts, for a variation of the partial pressure of oxygen between 0.2 and 2 bars.

The amplifier 53 is an operational amplifier having a feed-back loop containing a potentiometer 51. The output Vs of the amplifier 53 is therefore adjusted to the value of standardization through the intermediary of the potentiometer 51, for example, 0.084 volts for a partial pressure of oxygen of 0.21 bars. This voltage Vs is compared to a reference voltage Vc furnished by the circuit 44 which circuit comprises the commutator 28 and a series of standardizing resistances 28*a.* The values hereinabove show that the circuit can be fed by a stabilized voltage $V_p = 0.8$ volts.

The subtractor 43 includes an amplifier stage which has a gain of 10. The voltage $\epsilon$ delivered by the subtractor 43 is proportional to the difference between the reference voltage Vc and the voltage Vs delivered by the amplifier 53. $\epsilon = 10\ (Vs - Vc)$.

The positive input of comparator 46 is connected to ground.

The output voltage VE of comparator 46 changes sign when $\epsilon$ changes sign.

$$\epsilon > 0 \quad VE = -12 \text{ volts} \quad IE = 0$$

$$\epsilon < 0 \quad VE = +12 \text{ volts} \quad IE = 1$$

IE is the logic state representative of the voltage VE.

The reference voltage Vc delivered by the circuit 44 is fed to the input of inverter 45 which delivers an output voltage equal to the reference voltage, but changed in sign, i.e., − Vc. Through the intermediary of a divider bridge 52 with two legs, there is produced a voltage equal to −V c/2 which constitutes the second threshold value and which is sent to an input of the comparator 47, the second input of which receives the error voltage $\epsilon$. The output voltage VIc of the comparator 47 will be $(-Vc/2) - \epsilon$.

$$-\frac{Vc}{2} - \epsilon > 0 \Longrightarrow \epsilon < -\frac{Vc}{2} \quad VIc = +12 \text{ volts and } Ic = 1$$

$$\epsilon > -\frac{Vc}{2} \quad VIc = -12 \text{ volts and } Ic = 0$$

Ic is the logic state representative of the voltage VIc.

Assuming S to be the effective partial pressure of oxygen in the respiratory bag expressed in bars, and C, the consigned value of the partial pressure of oxygen expressed in bars.

It is desired that when:

S−C < (−C/2) the feed of oxygen is continuous;
(−C/2) < S−C > 0, the feed of oxygen is intermittent;
S−C > 0, there is no feed of oxygen.

These equations are equivalent to the following:

If $\epsilon = Vs - Vc < (-Vc/2)$, there is continuous feed of oxygen.

If $(-Vc/2) < \epsilon < 0$, intermittent feed.

$\epsilon > 0$, no feed.

The table of values is the following:

| | | IE | Ic | Feed of Oxygen |
|---|---|---|---|---|
| $S - C < -\frac{C}{2} < 0$ | $\epsilon < -\frac{Vc}{2} < 0$ | 1 | 1 | 1 |
| $-\frac{C}{2} < s - c < 0$ | $-\frac{Vc}{2} < \epsilon < 0$ | 1 | 0 | Q1 |
| $S - C > 0$ | $\epsilon > 0$ | 0 | 0 | 0 |

Q1 represents the logic state 1 during the time constant R1 C1 of the multivibrator described hereafter.

The logic function to be realized is therefore:

Feed of oxygen = (Q1.IE) + Ic.

The combination IE = 0, Ic, = 0 which would correspond to S−C < (−C/2) >0 is impossible.

The circuit 48 effects the logic for control of the electrovalve 36. It is an astable multivibrator in which there are two transistors 90 and 91 which serve the function of logic gates which block the multivibrator at the high state or at the low state according to the case at hand. The transistors 92 and 93 constitute the elements of the base of the multivibrator whose output is connected to the collector of the transistor 93.

When VE = −12 volts, IE = 0, and also VIc = −12 volts, Ic = 0. The transistors 90 and 91 are blocked and the multivibrator is blocked at the low state. The output voltage of the multivibrator in the vicinity of 0 volts is fed to the base of the transistor 94 which is then found in the blocked state. The circuit 95 is neutralized and signals the closure of the electrovalve 36.

When VE = +12 volts, IE = 1, the transistor 90 is saturated and is conductive. The operation of the multivibrator only depends on the state of the transistor 91. For VE = +12 volts, and when VIc = −12 volts, Ic = 0, the transistor 91 is blocked and is non-conductive. The multivibrator oscillates and the signal delivered by the collector of the transistor 93 is a train of pulses whose characteristics are determined by the time constants R1·C1 and R2·C2 of the multivibrator. This train of pulses is fed to the collector of the transistor 94 mounted as a switch at the input of circuit 95 comprising a self-induction coil 96 which controls the electrovalve 36 whih remains open during the time constant R1·C1 and is intermittently closed during the time constant R2·C2. This state corresponds to anintermittent feed of oxygen into the bag 8.

When VE = +12 volts, and VIc = +12 volts, Ic = 1, the transistors 90 and 91 are saturated and are conductive. The base of transistor 93 is thus short-circuited with the emitter of 93 and the multivibrator remains blocked in the high state, the output voltage of the multivibrator being thus +12 volts and applied to the base of 94 which is in the saturated state, the self-induction coil 96 is fed continuously and effects the opening of the electrovalve. This state corresponds to a continuous feed of oxygen into the bag 8.

The operation which has just been described is a control operation, either continuous or intermittent, of the electrovalve 36 according to the value of the difference between the assigned value and the actual value of partial pressure of oxygen with respect to the thresholds zero and (−Vc/2).

Two adjustable parameters are used, i.e., the time constant T1 = R1.·C1 which fixes the time of opening of the electrovalve and the time constant T2 = R2·C2 which fixes th period of the intermittent feed during T1. The mean feed D2 obtained with the intermittent openings is equal to the continuous feed D1 multiplied by (T1/T1+T2). One can control D1, T1 and T2 to improve the rate of regulation. Tests have shown that one such regulation for admission of oxygen with two thresholds one of which controls one opening intermittently with the other, much greater, a continuous opening of the electrovalve, permits with an assigned value fixed at 0.26 bar to obtain a partial pressure of oxygen constantly remaining between 0.24 and 0.26 bars.

It is to be noted that the error voltage $\epsilon$ is a relative value with respect to the assigned value since the second threshold is directly related to the value of the assigned voltage by the relation (−Vc/2). The errors conditioning the modes of operation of the control logic of the electrovalve 36 depend on the value of the assigned voltage determined by the position of the commutator 28.

If one chooses Vc = Vs = 0.084 volts for a partial pressure of standardization of 0.21 bars, this translates as one bar representing 0.4 volts.

Taking, for example, a consigned value C = 0.40 bar → Vc = 0.16 volts. We have seen that VIc is of the sign (−Vc/2) − $\epsilon$ and that $\epsilon$ = 10 (Vs − Vc). VIc changes sign when (−Vc/2) − $\epsilon$ = 0 or $\epsilon$ = (−Vc/2)

$$10(Vs - Vc) = -\frac{Vc}{2}\ Vs - Vc = -\frac{Vc}{20} =$$

-continued $$-\frac{0.16}{20} = -0.008\ V.$$

0.008 V represents of difference Δ between the actual partial pressure of oxygen S and the consigned value C of 0.02 bars and Δ = (−5C/100).

The apparatus comprises in addition a high and low alarm circuit, not represented in FIG. 4, whose principles of operation is analogous to the illustration in FIG. 4. One compares the error voltage $\epsilon$ = 10(Vs−Vc) to a lower threshold equal to −Vc for the low alarm and to +Vc for the high alarm.

The voltage −Vc is available to the output of the inverter 45 and the voltage +Vc to the output of the commutator 28. The thresholds of alarm as well as the thresholds of control for the feed of oxygen are therefore directly related to Vc.

If $\epsilon$ > Vc, there will be a high alarm, and if $\epsilon$ < −Vc, there will be a low alarm. In absolute value, the alarms are closed at the time that the absolute value |Δ| of the difference between the actual partial pressure of oxygen S and the assigned value C is greater than |(C/10)|.

Therefore, for an assigned value C =0.40 bars, the high alarm is closed when S > 0.44 and the low alarm when S < 0.36 bars.

Figure 7:
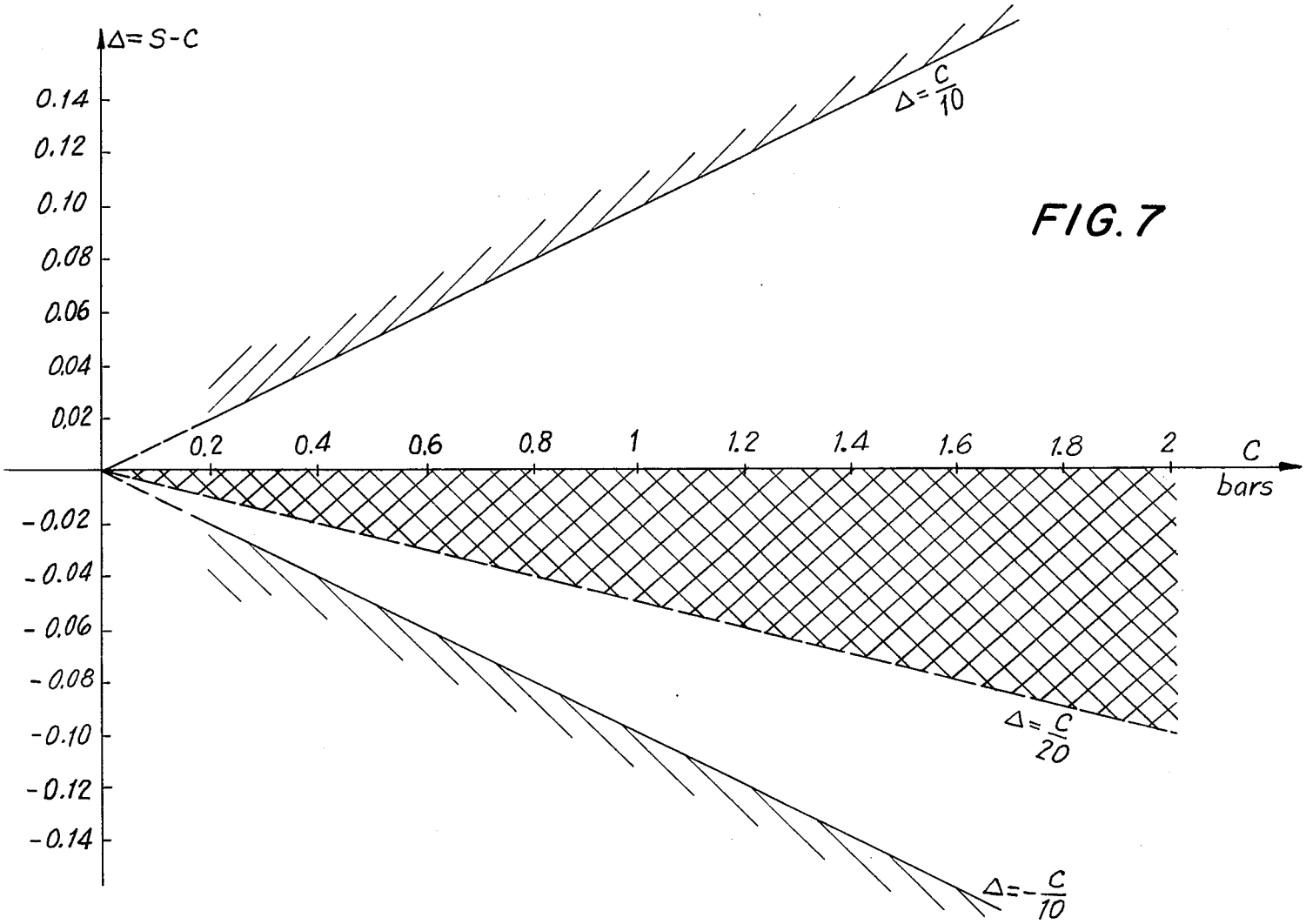
FIG. 7 is a graph showing curves defining zones of operation of the apparatus.

FIG. 7 shows along the abscissa the assigned value C expressed in bars and along the ordinate, the algebraic value of the difference Δ = S+C also expressed in bars.

The full lines Δ (=C/10) and Δ =(−C/10) limit the zones beyond which the high and low alarms are closed.

The dotted lines Δ = (−C/20) delimit the cross hatched zone corresponding to an intermittent feed of oxygen, the zone situated below the dotted lines corresponding to a continuous feed. The limit for regulation of the partial pressure of oxygen is thus fixed at ± 10% with respect to the assigned value. Of course, one can choose a different relation than 10 by varying the gain of the amplifier 43 or choosing as the alarm thresholds and as the continuous feed threshold fractions of the assigned value different from those which have been chosen which would modify the slope of the lines separating the zones in FIG. 7. The significance if that the thresholds remain proportional to the assigned value C.

Returning to FIG. 3, there is shown at the left side of the figure the display circuits for the electroluminescent diodes 27 of the numerical values of the partial pressure of oxygen indicated to two significant figures.

The numerical display circuits of a voltage are well known to those skilled in the art and no detailed description is deemed necessary.

The voltage Vs proportional to the partial pressure of oxygen delivered by the amplifier 53 is fed to comparator 56 which compares it to a saw-tooth voltage furnished by an integrator circuit 57. The output signal of the comparator 56 opens an AND gate 58 which allows passage of pulses of constant frequency furnished by a clock pulse generator 59 over all of the time when the voltage Vs remains greater than the linearly varying values of the saw tooth voltage. The pulses are recorded by pulse counter 60. The number of pulses counted measures the standardization of the value of the voltage Vs. The counter 60 is connected through logic gates 61, which permit nothing to be displayed when the counting is in progress, to a decoder 62 which is connected to the numerical display apparatus 27. A zero reset 64 constituted by two monostable loops, whose time constants are of the order of 100 microseconds and 3 milliseconds, controls the resetting to zero of the counter 60 and the return to zero of the integrator 57.

The return to zero of the integrator is obtained by saturating a transistor 98 which short-circuits the capacitor 99 of the integrator.

Conventional display circuits have been adapted to this particular application in order to reduce the consumption of energy.

Although presently known indicators with electroluminescent diodes comprise three display figures, we have only utilized two of them which permits indicating the partial pressure of oxygen in hundredths of bars, therefore with a sufficient precision.

The numerical display is not continuous. The diver controls a switch by means of button 29 placed on the bracelet fixed on the wrist which permits him to control the luminous display as and when he desires.

The circuits for conversion of analog to digital permitting the numerical measurement of a voltage by comparison of successive samples with a linearly crossing voltage comprises, as is conventional, buffer memories interposed between the counter and the display to store the information in a memory between two standard samples and dispose a permanent display. These memories have been omitted to reduce the complexity of the system and to reduce the energy demands.

The luminous display of the numerical value of the partial pressure of oxygen on a fixed indicator at the wrist of the diver allows a good visibility in the water.

Figure 5:
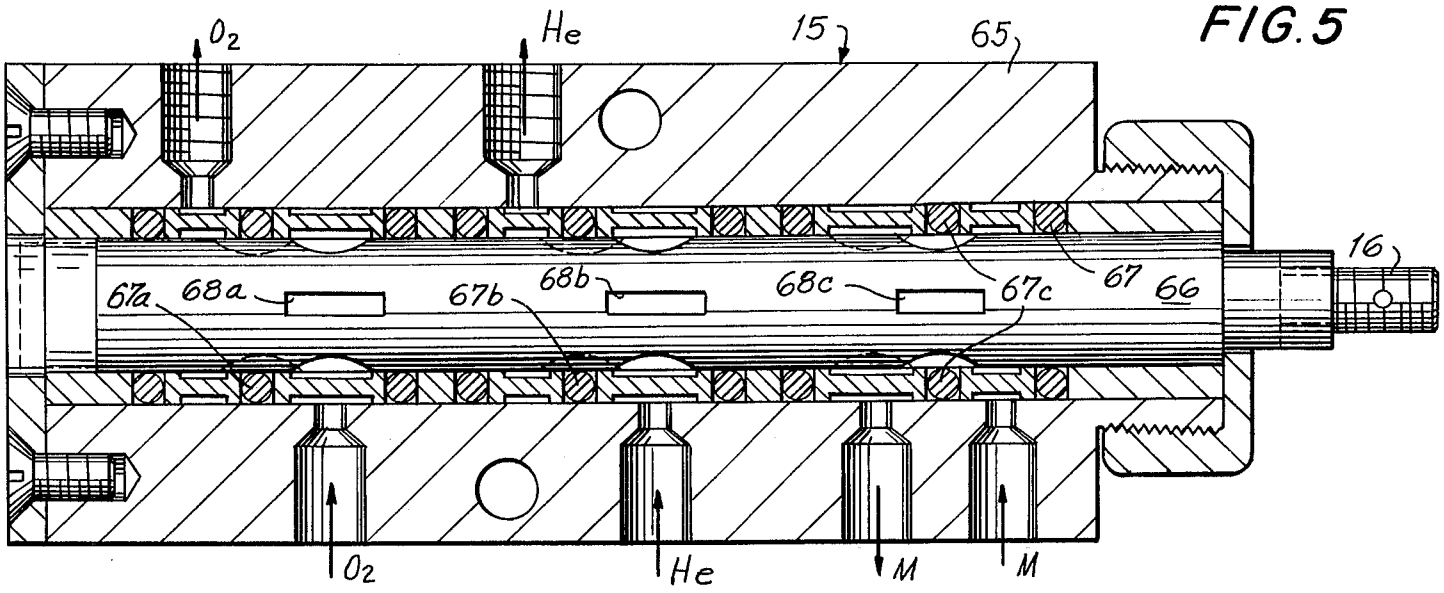
FIG. 5 is a longitudinal sectional view of a slide distributor of the apparatus.

FIG. 5 is a longitudinal section through the distributor 15.

The distributor comprises a cylindrical body 65 at the interior of which is placed a slide member 66 solid with the manipulation lever 16. The body 65 has six connections for the respective inlet and outlet conduits of oxygen, helium and of the respiratory mixture. These connections are respectively designated $O_2$, He and M, the arrows indicating the direction of flow. They are longitudinally spaced.

Around the slide are disposed toroidal seal members 67 on opposite sides of the connections for the conduits. The slide 66 has three sets of grooves **68*a*, 68*b* and 68*c*.**

In the position of the slide shown in solid lines, the grooves **68*c* are situated opposite toroidal seal member 67*c* which separates the conduits for inlet and discharge of the respiratory emergency mixture M. This mixture can therefore flow around seal member 67*c* by following the grooves whereas the distribution of oxygen and of helium are interrupted by the seal members 67*a* and 67*b*.**

In the position of the slide shown in dotted lines, the grooves **68*a* and 68*b* are adjacent the seal members 67*a* and 68*b*.**

The oxygen and helium flow through the distributor whereas the flow of the emergency respiratory mixture M is interrupted by the seal member **67*c*.**

The lever 16 controls the movement of the slide 66 between the two positions under the action of the diver.

Figure 6:
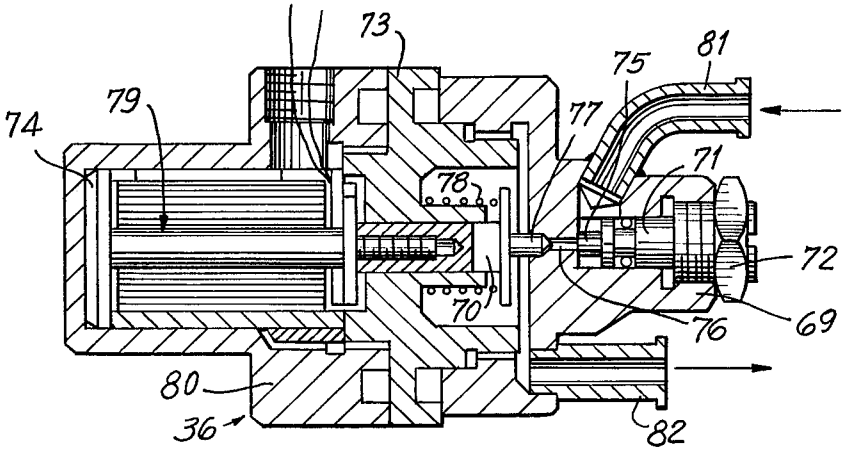
FIG. 6 is a longitudinal sectional view of an electrovalve of the apparatus.

FIG. 6 is a longitudinal section of the electrovalve 36. It has been necessary to provide a special electrovalve for the respiratory apparatus according to the invention, since it must have a low consumption of energy and be of a reduced size.

This electrovalve comprises a body 69 of generally cylindrical form closed at one extremity by a threaded stopper 71 with a blocking screw 72, an inlet tube 81 for gas and an outlet tube 82 for gas.

At the other extremity of the body 69, there is a valve guide 73. Reference numeral 70 designates a guide stem of the valve in the form of a centering pin 77 applied against its seat by a spring 78. Numeral 79 designates an electromagnet placed at the interior of a cover 80. An elastic abutment 74 maintains the electromagnet applied against the valve guide 73.

The operation is as follows:

The valve is an on or off valve and is controlled by the feed circuit of the coil 79. The stopper 71 solid with a pin 75 permits adjustment of the flow of oxygen by obstructing orifice 76 by a greater or lesser amount.

When the coil of the electromagnet 79 is excited, the member 70 is pulled towards the electromagnet and the pin 77 opens the leakage orifice 76. A flow of oxygen is therefore established between the inlet 81 and the outlet 82 through the intermediary of the orifice 76 which is calibrated.

In order to close the valve, the electromagnet is de-energized which frees the member 70 and the spring 78 pushes the pin 77 which blocks the leakage orifice 76.

It is seen that the energy expended by the electromagnet 79 acts solely to displace the pin 77 to create a leakage. Since the pressure in the conduit 81 is very low, but sufficient to obtain a suitable flow of oxygen at the outlet of the tube 82, the recall force of the spring 78 is therefore also very low to maintain the pin 77 against the orifice 76. The displacement of the member 70 is also very small and thereby the energy expended by the electromagnet to displace the member 70 is also very low.

Of course, it is understood that without departing from the framework of the invention, numerous parts of the circuit and of the apparatus, which have just been described by way of example, could be replaced by equivalent elements well known to those skilled in the art.

What is claimed is:

1. Respiratory apparatus for an underwater free diver comprising a sealed and deformable respiratory bag in pressure equilibrium with the exterior, diver connection means connected to said bag for permitting a diver to breath into and from said bag, absorbant means for $CO_2$ connected to said bag and to said diver connection means for passage of exhaled gas therethrough, an oxygen container connected to said bag, a container of compressed neutral gas connected to said bag, a valve controlling the connection of the neutral gas container with said bag, actuator means coupled to said valve and operated by said bag upon reduction of the volume thereof for opening said valve to admit neutral gas into said bag, sensor means for sensing the actual partial pressure of oxygen in said bag, said sensor means producing a voltage proportional to said actual partial pressure, an electrovalve controlling the connection of the oxygen container to said bag, electronic regulation means connected to said sensor means and to said electrovalve for automatically controlling said electrovalve to maintain the partial pressure of oxygen in said respiratory bag substantially equal to an assigned adjustable value, and a sealed casing containing said electrovalve and said electronic circuit means, said electronic regulation means comprising a subtractor for producing a signal equal to the difference between an adjustable reference voltage corresponding to the assigned value of the partial pressure of oxygen and the voltage furnished by the sensor means for automatically controlling the closure of the said electrovalve when the difference is less than a first threshold zero level, and a comparator means coupled to said subtractor for comparing the difference between the assigned value and the actual value of the partial pressure of oxygen to a second positive threshold value equal to a fraction of the reference voltage for effecting successive and discontinuous opening of the electrovalve when this difference is positive and less than the second threshold valve and for effecting continuous opening of the electrovalve when said difference is greater than the second threshold value.

2. Respiratory apparatus for an underwater free diver comprising a sealed and deformable respiratory bag in pressure equilibrium with the exterior, diver connection means connected to said bag for permitting a diver to breathe into and from said bag, absorbant means for $CO_2$ connected to said bag and to said diver connection means for passage of exhaled gas therethrough, an oxygen container connected to said bag, a container of compressed neutral gas connected to said bag, a valve controlling the connection of the neutral gas container with said bag, actuator means coupled to said valve and operated by said bag upon reduction of the volume thereof for opening said valve to admit neutral gas into said bag, sensor means for sensing the partial pressure of oxygen in said bag, said sensor means producing a voltage proportional to said partial pressure, an electrovalve controlling the connection of the oxygen container to said bag, electronic regulation means connected to said sensor means and to said electrovalve for automatically controlling said electrovalve to maintain the partial pressure of oxygen in said respiratory bag substantially equal to an assigned adjustable value, and a sealed casing containing said electrovalve and said electronic circuit means, said electronic regulation means comprising a subtractor for producing a signal equal to the difference between an adjustable reference voltage corresponding to the assigned value of the partial pressure of oxygen and the voltage furnished by the sensor means, a first comparator with logic circuit coupled to said subtractor and electrovalve for automatically controlling the closure of said electrovalve when said signal is less than a first threshold zero level, a second comparator with said logic circuit coupled to said subtractor and said electrovalve for comparing said signal to a second positive threshold value equal to a fraction of the reference voltage for effecting successive and discontinuous opening of the electrovalve when this difference is positive and less than the second threshold value and for effecting continuous opening of the electrovalve when said difference is greater than the second threshold value.

3. Respiratory apparatus for an underwater free diver comprising a sealed and deformable respiratory bag in pressure equilibrium with the exterior, diver connection means connected to said bag for permitting a diver to breathe into and from said bag, absorbant means for $CO_2$ connected to said bag and to said diver connection means for passage of exhaled gas therethrough, an oxygen container connected to said bag, a container of compressed neutral gas connected to said bag, a valve controlling the connection of the neutral gas container with said bag, actuator means coupled to said valve and operated by said bag upon reduction of the volume thereof for opening said valve to admit neutral gas into said bag, sensor means for sensing the partial pressure of oxygen in said bag, said sensor means producing a voltage proportional to said partial pressure, an electrovalve controlling the connection of the connection of the oxygen container to said bag, electronic regulation means connected to said sensor means and to said electrovalve for automatically controlling said electrovalve to maintain the partial pressure of oxygen in the said respiratory bag substantially equal to an assigned adjustable value, a sealed casing containing said electrovalve and said electronic circuit means, a bracelet with means for attachment around the wrist of the diver, a display indicator on said bracelet coupled to said electronic regulation means for indicating the partial pressure of oxygen, and a commutator on said bracelet coupled to said electronic means for varying the partial pressure of oxygen.

4. Respiratory apparatus according to claim 3, wherein said casing containing said electrovalve and said electronic circuit means communicates with the interior of said respiratory bag and thereby is in pressure equilibrium therewith.

5. Apparatus according to claim 3 further comprising a third container containing a respiratory mixture of oxygen and compressed neutral gas, and distributor means connected to said containers and to said bag for admitting respective substances into said bag from said containers, said distributor means including a spool valve having two operative positions, and a control member coupled to the spool valve for placing the spool valve in a selected one of said positions, in a first of said positions interrupting the feed to the respiratory bag from the oxygen container and from the neutral gas container while providing emergency feed from the third container containing the respiratory mixture, and in the second position interrupting feed from the third container while providing feed from the oxygen container and from the neutral gas container.

6. Apparatus according to claim 5, wherein said distributor comprises a cylindrical body with six apertures for inlet and outlet respectively of oxygen, neutral gas and respiratory mixture, said apertures being distributed longitudinally along said casing, a cylindrical slide member secured to said control member, toroidal seals on said slide disposed on opposite sides of each of the apertures forming sealing engagement betwen the slide and the cylindrical body, said slide having three sets of grooves disposed thereon such that in one position of the slide member the torodial seals between the inlet and outlet apertures for the oxygen and neutral gas are situated opposite two sets of grooves while the third set of grooves is situated between two successive toroidal seals whereas in the other position of the slide member the third set of grooves is situated opposite the toroidal seal separating the inlet and outlet conduits of the respiratory mixture while the two other sets of grooves are situated between two successive toroidal seals.

7. Respiratory apparatus according to claim 3 wherein the display indicator on said bracelet includes electroluminescent diodes coupled to said electronic regulation means for indicating to at least two significant figures the partial pressure of oxygen, a flexible tube connecting said indicator to said bag to provide pressure equilibrium therebetween, and electrical condutors disposed in said tube and connecting said electronic means and said indicator.

8. Apparatus according to claim 7 comprising switch means on said bracelet for selective display on the indicator of the partial pressure of oxygen.

* * * * *